US005226790A

United States Patent [19]

Serafin

[11] Patent Number: 5,226,790

[45] Date of Patent: Jul. 13, 1993

[54] PERIPHERAL-LONGITUDINAL DIFFUSSER FOR A SINGLE-IMPELLER CENTRIFUGAL PUMP

[75] Inventor: Carlo Serafin, Vicenza, Italy

[73] Assignee: Calpeda Spa, Montorso Vicentino, Italy

[21] Appl. No.: 711,091

[22] Filed: Jun. 6, 1991

[30] Foreign Application Priority Data

Jun. 8, 1990 [IT] Italy ..... 85579 A/90

[51] Int. Cl.[5] ..... F01D 1/06

[52] U.S. Cl. ..... 415/208.3; 415/172.1; 415/182.1; 415/226; 415/228

[58] Field of Search ..... 415/58.2, 58.3, 170.1, 415/172.1, 182.1, 208.1, 208.2, 208.3, 208.5, 226, 228, 56.1; 417/80, 84, 89

[56] References Cited

U.S. PATENT DOCUMENTS

| | | | |
|---|---|---|---|
| 2,766,698 | 10/1956 | Carter | 415/208.3 |
| 2,934,021 | 10/1956 | Conery et al. . | |
| 2,941,474 | 8/1956 | Hall . | |
| 3,307,485 | 3/1967 | Logue | 415/208.2 |
| 3,826,589 | 7/1974 | Frank et al. | 415/208.3 |
| 3,920,352 | 11/1975 | Speck et al. | 415/182.1 |
| 4,453,886 | 6/1984 | Wilson | 415/208.3 |
| 5,069,599 | 12/1991 | Carretta | 415/182.1 |

FOREIGN PATENT DOCUMENTS

| | | |
|---|---|---|
| 0361328 | 4/1990 | European Pat. Off. . |
| 3718273 | 5/1987 | Fed. Rep. of Germany . |

OTHER PUBLICATIONS

The "Bud-Jet" Pump Publication Brochure Form No. 269-1, published by Aermotor Company, Nov., 1958.

*Primary Examiner*—Edward K. Look
*Assistant Examiner*—Christopher Verdier

[57] ABSTRACT

The invention discloses a single-impeller pump with a diffuser (1, 40, 50, 60, 80, 100, 120, 130) arranged in front of the impeller (14, 46, 57, 107) on the suction side of the impeller (14,46,57,107) which evolves in the longitudinal direction toward the pressure chamber (21,67,112) with channels (10, 72, 90, 109, 128, 139) arranged around the periphery of the funnel or wall (13, 42, 52, 69, 88, 102, 125, 135) which is present within the pump casing (11, 66, 85, 114, 127, 136) and is comprised between the suction opening (27), or an eventual ejector (44, 104), and the casing cover (12, 56, 64, 84, 110, 123, 133). The channels (10, 72, 90, 109, 128, 139) act as diffusers and send longitudinally and without any rotation into the pressure chamber (21, 67, 112) the flow streaming out of the impeller (14, 46, 57, 107) which is conveyed into the longitudinal channels (10, 72, 90, 109, 128, 139) by baffles (17, 63, 83, 122, 132) and blades (16, 62, 82) arranged around the periphery of the impeller (14, 46, 57, 107).

10 Claims, 7 Drawing Sheets

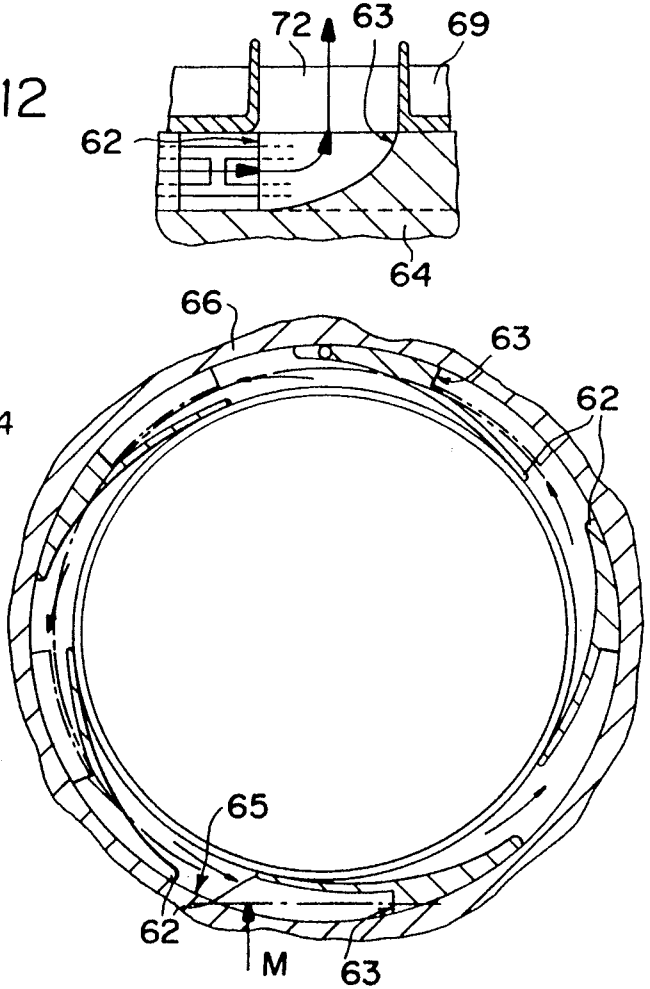
FIG.9
FIG.12
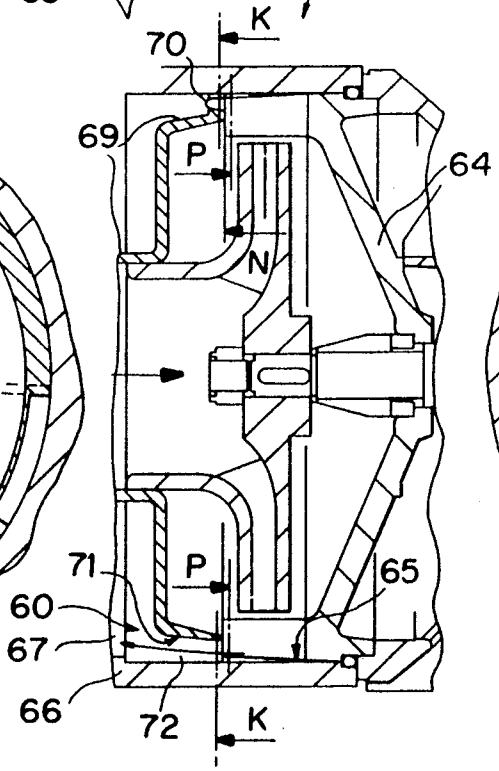
FIG.8
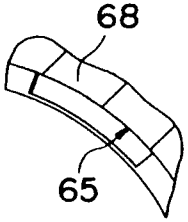
FIG.11
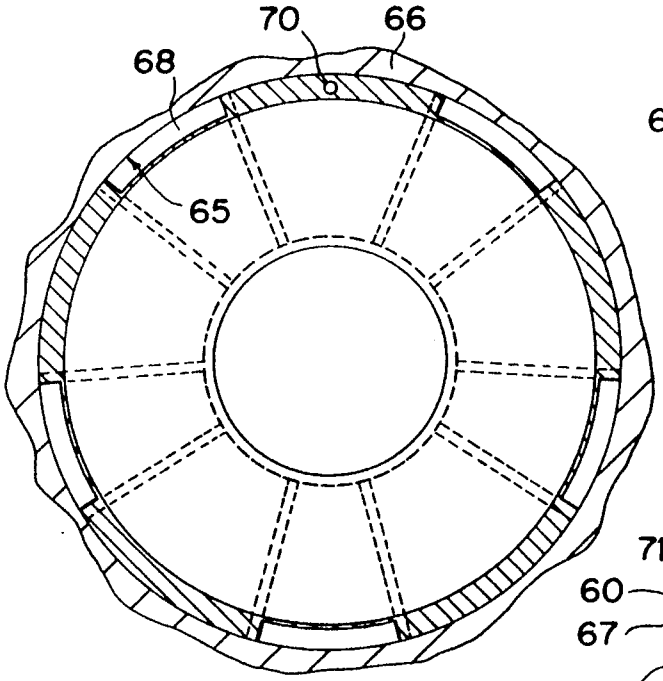
FIG.10

PERIPHERAL-LONGITUDINAL DIFFUSSER FOR A SINGLE-IMPELLER CENTRIFUGAL PUMP

BACKGROUND OF THE INVENTION

The present invention concerns a diffuser for a single-impeller centrifugal pump, particularly suited to be advantageously applied on plastic self-priming swimming pool pumps or whirlpool pumps and to self-priming ejector pumps, usually known as "jet" pumps.

It is a known fact that a self-priming pump is a pump for liquids which, when started, can suck by itself the air which is present in the suction piping, after the pump casing alone has filled up with liquid. A pump is primed when the waterways of the pump are filled with the liquid to be pumped.

It is also a known fact that in the single-impeller centrifugal self-priming pumps there is a diffuser, i.e. a duct having a cross-section which increases in the direction of the flow, which has the task of transforming as much as possible the kinetic energy of the liquid streaming out of the impeller into pressure energy.

The single-impeller centrifugal pumps of the above-mentioned types include a bladed diffuser having a round shape and radial outlets, which is arranged around the periphery of the impeller in the pump casing such a diffuser is positioned within an annular chamber closed around the periphery and axially open for the "jet" pumps, or within a chamber open both radially and axially in the swimming pool pumps. The known type of diffusers having blades with the mentioned radial outlets present, however, some inconveniences.

A first inconvenience arises from the fact that the pumped liquid flows out of the diffuser with a tangential or a helicoidal direction and, during the priming phase, it drags along the air contained in the pump casing. The centrifugal effect separates the air from the liquid. The air has a tendency to collect around the axis of rotation in the pressure chamber or to flow back radially through the diffuser to the hub of the impeller and it arrives with difficulty at the delivery connection. For this reason the pumps built according to the known techniques require extensive longitudinal baffles or other devices, in order to slow down the rotation in the pressure chamber or they require manually operated adjustment devices such as throttle valves or methods of topping up with water through the delivery pipe, in order to obtain the priming with the maximum suction lifts.

Another inconvenience consists in the fact that the presence of the radial diffuser causes an increase in the radial overall dimensions of the pump, since the blades are usually, although not always compulsorily, overlapped between the inlet and the outlet, in order to obtain a diffuser duct. This requires around the diffuser a relatively high circular rim, so that the outer diameter of the pump equals the diameter of the impeller plus the height of the diffuser, plus the height of a possible annular free chamber, plus the thickness of the pump casing.

In the swimming pool pumps or whirlpool pumps with a traditional radial diffuser, the height of the axis of the pump casing exceeds the height of the motor axis. Because of the weight differences of the plastic materials of the pump and the metal materials of the motor, the center of gravity of the unit is under the motor, in spite of the larger volume of the pump casing. In order to hold the unit in a horizontal position, these pumps require an added support consisting of one or more parts fastened with screws which, when applied under the motor, must exceed the axis height of the pump or, when applied under the pump extends down to the center of gravity under the motor. This results in further inconveniences relating to the stability and the structural sturdiness, while entailing some complications for the manufacture and the assembly, and because of the increase in weight and costs.

Moreover, in the mentioned swimming pool pumps or whirlpool pumps, the impeller and the diffuser must be placed within the pressure chamber of the pump casing and this entails one more inconvenience, i.e. it decreases the useful volume for the amount of water with which the pump casing can be filled up at the start for the self-priming process.

Some "jet" pumps are known and they were disclosed by the patents DE/3718273, U.S. Pat. Nos. 2,941,474 and 2,934,021, wherein, in the attempt of solving the problem of the rotation and of the vorticity of the liquid and the air at the outlet of the diffuser, a separation wall or an added suitable component, such as a separating device or a perforated screen, is arranged behind the diffuser, in order to transversally divide the pressure chamber into a chamber with high vorticity and high rotational speed and a chamber with less turbulence and a decreased rotational speed.

Moreover, both "jet" pumps and plastic swimming pool pumps or whirlpool pumps are known, wherein the rotation of the liquid and the air within the pump casing is slowed down by means of extensive longitudinal baffles. These devices present, however, the inconvenience that they do not eliminate the origin of the vorticity and of the rotation of the liquid and the air, but they only intercept them in order to decrease their intensity with negative effects on the efficiency and on the noise level. The obstacles used to slow down the rotation present yet the further inconvenience that they also increase the friction on the water in the pump casing, so that the temperature of the water reserve contained in the pump casing increases in a shorter period of time.

This limits the self-priming capacity and reduces the period of time during which the pump can function without being damaged, if the water reserve is not renewed because of accidental causes, as when the pump keeps on running with a closed gate valve or with the suction pipe not immersed in the water because of the lowered water level of the pool.

Another known "jet" pump is the one disclosed in the patent application EP0361328 by the same inventor which presents a diffuser of the axial type arranged in front of the impeller on its suction side, with some return channels converging to a central exit, without any rotation of water and air within the pressure chamber. Although this axial diffuser eliminates the inconveniences of the radial diffuser in the above-described applications and practically fulfils the same purposes of the present invention, it presents the inconvenience for the manufacturer that it requires two pieces (added between the pump casing and the casing cover) with a complicated blades system. It also requires the addition of a metal wear ring, in order to protect against abrasive substances the clearance of the non-contact seal ring on the impeller, when the impeller and/or the diffuser are made of plastic material. Said axial diffuser also presents the inconvenience that, if it is made only with the single central exit, it leaves in its interior and on the impeller side an air pocket when it is filled up for the first time and a water pocket when it is drained.

SUMMARY OF THE INVENTION

The purpose of the present invention is to eliminate the above-mentioned inconveniences.

One purpose of the invention is to obtain a diffuser, the outlet flow of which enters into the pressure chamber of the pump without a rotational component, without separating water and air by centrifugal effect, so as to prevent the air from collecting around the axis and flowing back to the impeller hub and to make it easier for the air to exit from the delivery connection of the pump and to permit the self-priming process to become regular and automatic, the delivery connection remaining completely open even with the highest suction lift and without any need for additional devices other than the diffuser, which would have to be added, in order to reach this purpose. Another purpose of the invention is to obtain a lower noise single-impeller, self-priming centrifugal pump, by eliminating the rotation of the pumped liquid and of the water within the pump casing.

Another purpose of the invention is to obtain a diffuser permitting the construction of a pump casing having a smaller outer diameter, as compared with the outer diameter of a pump offering equivalent performances, whose impeller has the same diameter but uses a radial diffuser.

Yet another purpose of the invention is to obtain a diffuser having a single-impeller, self-priming centrifugal pump with a reduced axis height, in order to avoid the need for adding supports under the motor.

Yet another purpose of the invention is to obtain a diffuser reducing the friction on the water in the pressure chamber, so that the temperature of the water does not rise rapidly. Yet another purpose of the invention is to obtain a diffuser allowing for a larger useful volume for the quantity of water with which the pump casing can be filled at the start for the self-priming process. Another purpose of the invention is to obtain a diffuser permitting a more compact construction, smaller overall dimensions and a lighter weight, as compared with a single-impeller centrifugal pump with a radial diffuser, with an impeller having the same diameter and with a pump casing made of the same material. Another purpose of the invention is to obtain a diffuser which can be completed by adding a single part to the structural parts which are at any rate necessary for the construction of the pump, such as the pump casing and the casing cover, said additional part acting also as a metal sealing ring on the impeller. Another purpose of the invention is to obtain a diffuser which will not leave air pockets negatively influencing the self-priming process at the first filling up and which will not leave stagnating water when the pump is drained, thereby permitting the complete emptying of the pump. All the above-listed purposes and others which will become apparent hereinafter are fulfilled by a diffuser for single-impeller centrifugal pumps, comprising:

a pump casing provided with a suction opening with a delivery connection and a pressure chamber, into which an ejector is also eventually inserted;

a casing cover closing the pump casing;

a funnel or a wall within the pump casing comprised between the pressure chamber and the suction side of the impeller and also between the suction opening, or an eventual ejector, and the casing cover or a circular rim;

an impeller inserted into the pump casing and comprised between the funnel or wall and the casing cover, characterized in that it consists of a plurality of channels connected with the pressure chamber of the pump, wherein said channels have a longitudinal direction which is substantially parallel to the axis of rotation of the impeller in order to prevent the rotation of the flow coming from the impeller, are arranged in front of the impeller on the suction side of the impeller, oriented toward the pressure chamber, around the funnel or wall periphery, wherein baffles arranged around the periphery of the impeller are connected with the longitudinal channels. According to a preferred embodiment the baffles are provided with blades arranged around the periphery of the impeller.

According to a preferred embodiment, the diffuser of the invention is built so, that the task of the diffuser is divided among three components, each separate from the other, constituting the pump itself, and more precisely the pump casing, the casing cover or a circular rim and a funnel or wall, inserted into the pump casing between the suction opening or the ejector and the casing cover. The diffuser function can be obtained, as will be better explained hereinafter, also with the casing cover and the funnel or wall alone.

Advantageously, the diffuser according to the invention eliminates the flow rotation in the pressure chamber, thereby making it easier for the air to stream out of the delivery connection during the self-priming process, and preventing the air from separating and collecting around the central area of the pressure chamber or to flow back radially through the diffuser to the hub of the impeller.

Just as advantageously the diffuser according to the invention provides a single-impeller, self-priming centrifugal pump which is less noisy than the pumps built according to the known techniques and having equivalent characteristics and performances.

Moreover, advantageously the diffuser according to the invention permits the building of a pump having a reduced axis height, which can, therefore, be manufactured while avoiding the need for a tall support under the motor to make up for the excessive height of the pump axis, or of a long support under the pump because of the position of the center of gravity under the motor, this being especially the case when the pump is made of plastic material like swimming pool pumps or whirlpool pumps.

The pump also presents the advantage that it is more compact and weighs less than equivalent pumps with a radial diffuser, this feature being especially important for portable pumps and pumps which must be inserted into limited spaces, for instance against the sides of swimming pools or of whirlpool baths.

Moreover, the diffuser of the pump according to the invention can be built with an arrangement of the channels which excludes the creation of air pockets during the first filling-up and of water pockets after draining. The possibility of emptying completely the pump prevents damages to the pump in case of freezing temperatures and, when it is used in swimming pools or whirlpools, it improves on the hygiene of the installation. Moreover, advantageously, since the diffuser according to the invention is arranged in the pump casing outside the pressure chamber, in spite of its reduced radial dimensions, it allows for a comparatively larger useful inner volume so that the pump can be filled with a larger amount of water for the self-priming process at the first start-up and also a larger amount of water remains within the pump after it has stopped running, which will be useful for the following start up. The funnel or wall, advantageously, can be made of metal also for the plastic pumps used in swimming pools and whirlpools, in which, for safety reasons concerning electricity, the water should never come into contact with the metal parts of the motor. In fact, the funnel or wall is perfectly insulated because it is located between parts made of plastic material and can preferably be made from a sheet of stainless-steel. Thus it acquires also the function of a metal sealing ring on the impeller, thereby preventing jamming or irregular wear due to abrasive elements, even with small clearances and the function of connecting the pressure chamber or the ejector with the opening of the impeller through the pressure chamber.

By building the funnel or wall with a thin sheeet of steel, with a decreased volume of material, without any blades or baffles, a yet larger volume is obtained for the quantity of water with which the pump can be filled for the self-priming process at the first start up and for the quantity of water which remains in the pump after it has been stopped and which will turn useful at the following start up.

This construction of the diffuser with smooth walls without blades or baffles reduces the friction on the water, thereby preventing its temperature from quickly rising. This improves the self-priming ability, the safety and reliability under accidental conditions (for instance if the pump runs with a closed valve or with a suction pipe not immersed in the water).

BRIEF DESCRIPTION OF THE DRAWINGS

The above-mentioned purposes and others which will be better explained hereafter are illustrated in the description of preferred forms of execution of the invention, which are given by way of illustration only and which are represented in the drawings, wherein:

FIG. 8 shows a different embodiment of the diffuser of the invention, particularly suited to manufacture the diffuser funnel with plastic material;

FIG. 9 shows the transversal cross-section along the P—P plane of the pump of FIG. 8 with a front view of the blades and the baffles of the diffuser according to the invention;

FIG. 10 shows the transversal cross-section along the K—K plane of the embodiment of the diffuser represented in FIG. 8 with a front view of the front passages of the longitudinal channels made in the funnel and closed on the exterior of the pump casing;

FIG. 11 shows one of the front passages of the longitudinal channels of the diffuser according to the invention seen on the N plane of FIG. 8;

FIG. 12 shows the cross-section along the M plane of FIG. 9 with a view of the connection of one of the longitudinal channels made on the funnel, which constitute the embodiment of the diffuser according to the invention, with one of the baffles belonging to the casing cover;

DETAILED DESCRIPTION OF PREFERRED EMBODIMENTS

Figure 1:
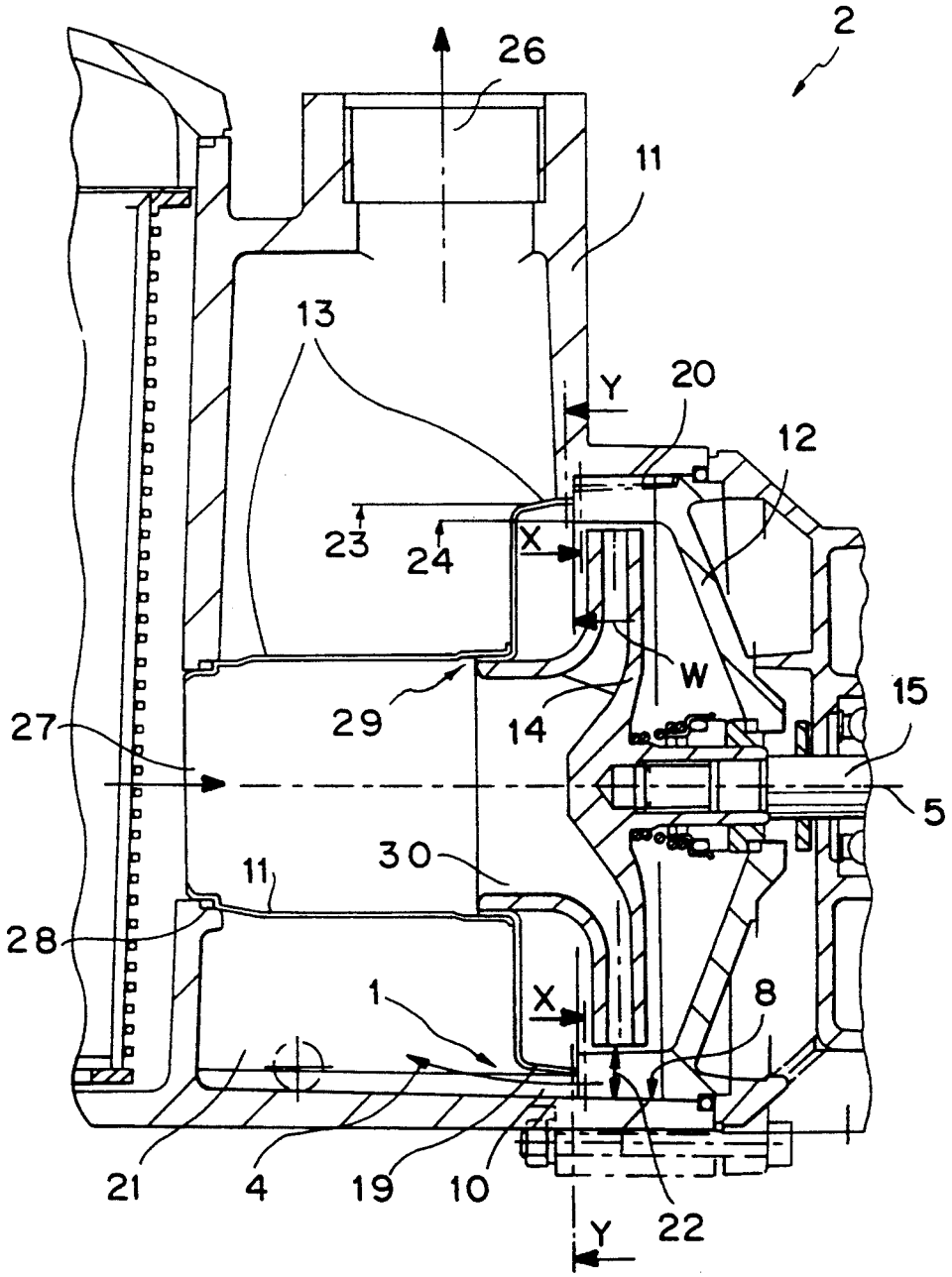
FIG. 1 shows a longitudinal cross-section of the diffuser according to the invention applied on a single-impeller, self-priming centrifugal swimming pool pump or whirlpool pump.

As can be observed in FIG. 1, the diffuser according to the invention is indicated as a whole with 1 and it is connected to a single-impeller, self-priming centrifugal pump 2, suited for swimming pools or whirlpools.

The description given hereinafter relates to the application of the diffuser according to the invention on the pump of the mentioned type. The description remains, however, valid, as will be seen more in detail hereinafter, also when applied to any other type of single-impeller centrifugal pump. Pump 2, as can be observed, consists of a pump casing 11, closed by a casing cover 12, in the interior of which there are funnel 13 and impeller 14, the latter being splined on the shaft 15 of the motor (not represented in the drawing).

Figure 5:
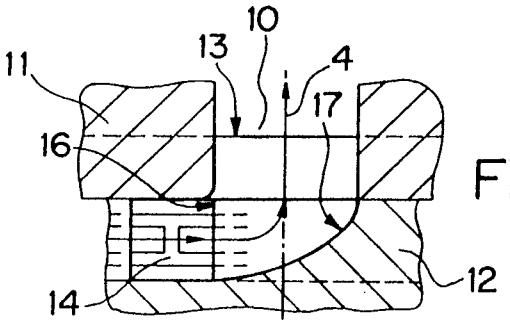
FIG. 5 shows the cross-section along the Z plane of the cross-section of FIG. 2 with a view of the connection of one of the longitudinal channels, obtained between the pump casing and the funnel, which constitute the diffuser, with one of the baffles obtained on the casing cover.
Figure 2:
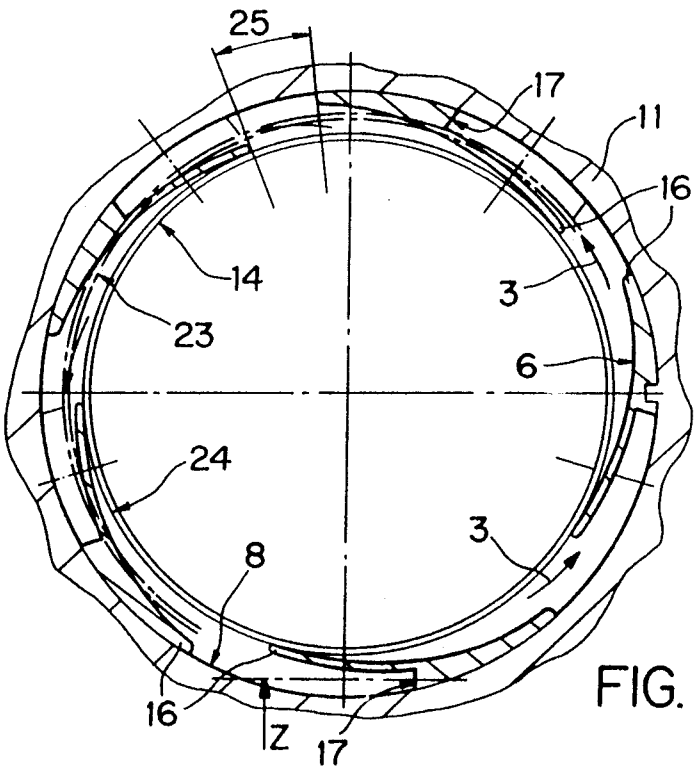
FIG. 2 shows the transversal cross-section along the X—X plane of the pump of FIG. 1 with a front view of the blades and of the baffles of the diffuser according to the invention.
Figure 4:
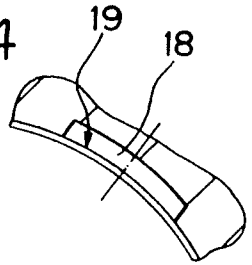
FIG. 4 shows one of the front passages of the longitudinal channels of the diffuser according to the invention seen from the W plane of FIG. 1.
Figure 3:
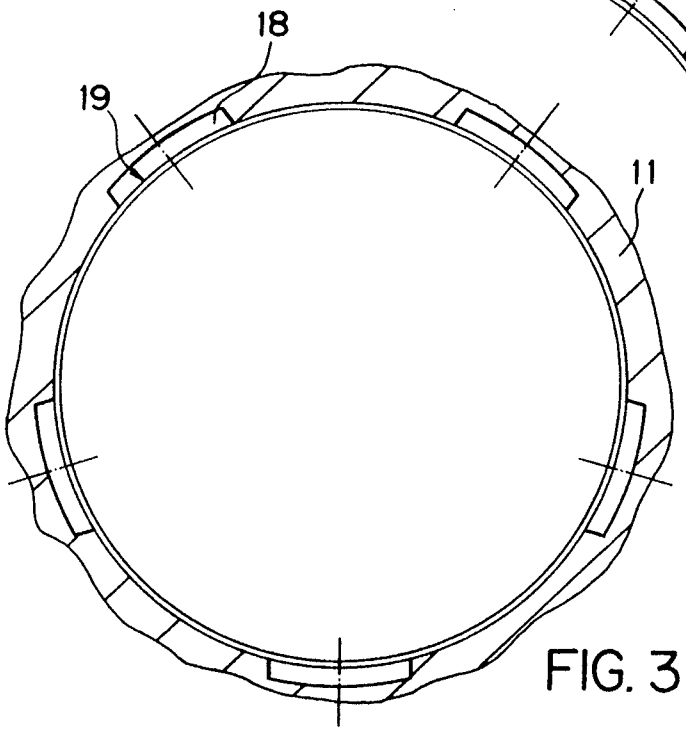
FIG. 3 shows the transversal cross-section along the Y—Y plane of the pump of FIG. 1 with a front view of the front passages of the longitudinal channels between the pump casing and the funnel of the diffuser according to the invention.

As can be observed in FIG. 1 and also in FIG. 2, the periphery of casing cover 12, on which the blades 16 are located and present a curve 6, extends around the periphery of impeller 14. As can be seen in FIG. 2, the blades do not overlap each other, on the contrary, they are separated by the free section marked with 25. The task of the blades is to scoop up the air as close as possible to the periphery of the impeller 14 and to convey it, together with the water, by preventing their separation due to the centrifugal force, in the direction marked by arrow 3 against the baffles 17, which can be seen more in detail in FIG. 5. The task of the baffles 17 is to divert the flow on to the front passages 18 of the longitudinal channels 10, represented in FIG. 1, in FIG. 3, in FIG. 4 and also in FIG. 5, following the longitudinal direction indicated by arrow 4, which is preferably parallel with the rotation axis 5 of impeller 14. The baffles 17 are also located around the periphery of casing cover 12 and, as can be seen in FIG. 2, they are circumferentially closed on the outer periphery through the annular wall 8 of the pump casing 11. Each longitudinal channel 10, with its front passage 18, is located on the pump casing 11 and it is closed toward the interior of the tapered belt 19 of funnel 13. Each longitudinal channel 10, as can be observed in FIG. 1, opens into the pressure chamber 21, located within the pump casing 11. Each longitudinal channel 10 along the periphery of funnel 13 constitutes, therefore, the diffuser, which, because of its construction characteristics and of the type of flow which occurs within it, we can call a "peripheral-longitudinal diffuser".

The application of casing cover 12 on the pump casing 11 occurs with the help of the locating rabbeted fit 20, as can be observed in FIGS. 1 and 2.

The flow streaming out of the channels 10 of diffuser 1 follows the direction marked by arrow 4, as can be observed in FIG. 1 and it is led toward the interior of the pressure chamber 21, into which it flows with a longitudinal direction and without any rotation, without any separation of air and water, due to a centrifugal force, and without any back-flow of the air toward the hub of the impeller, so that during the self-priming process of the pump, the air can more easily stream out of the delivery connection 26.

On the basis of this description it can be understood that the peripheral longitudinal diffuser 1 according to the invention reaches the proposed purpose of achieving a rotation-free flow into the pressure chamber 21. One consequence of this fact is a reduction of the noise level of the pump while it is running. The elimination of the rotation of the fluid, by means of the diffuser according to the invention, makes it possible to do away with longitudinal baffles or other devices positioned in the pressure chamber of the pump having the purpose of reducing the rotation, so that it is possible to have smooth walls with a minimum friction on the water, thereby insuring to the pump the regularity of the self-priming process with the delivery connection 26 completely open and solely with the filling up of the pump casing with liquid, before the start-up, even under the conditions of maximum suction lifts.

On the basis of the description it is also easy to understand that the diffuser 1 according to the invention provides a single-impeller, centrifugal pump having more reduced overall radial dimensions as compared with equivalent pumps, thereby eliminating the need for the application of an added support on the center of gravity with unfavourable conditions of excessive difference of bulk and weight between the pump and the motor. In fact, it can be seen, by observing FIG. 1, that the radial distance 22 between the periphery of the centrifugal impeller 14 and the interior of the pump casing 11 is reduced to the very minimum since, as can be seen in more detail in FIG. 2, the blades 16 of diffuser 1 do not radially overlap each other at any spot, but are separated from each other by the free section 25. It has also been observed that the diffuser according to the invention provides in the pressure chamber 21 a larger volume available for the water reserve which is needed at the start of the self-priming process.

It has also been seen that the diffuser according to the invention is made by adding to the structural parts of the pump, i.e. to the pump casing 11 and the casing cover 12, exclusively funnel 13, which is placed between the suction opening 27, with the interposition of seal 28 and the front part of casing cover 12. Thus, the funnel 13 also functions a metal sealing ring 29 on impeller 14, which will prevent possible jammings or irregular wear, even with small radial clearance, and also the function of connecting the suction opening 27 with the opening 30 of impeller 14, through the pressure chamber 21. According to the dimensions of funnel 13 and to the technological methods used for its construction, the funnel can be made in a single piece by die-forming or it can be made of several parts, which will be welded or fitted together, whereby, in the latter case, it can also be built of different metals and/or the pieces can be detacheable from one another.

In FIG. 1 and in FIG. 2 the inner diameter 23 of funnel 13 is larger than the inner diameter 24 of the blades 16 on casing cover 12, because funnel 13 is also foreseen for an impeller 14 having a larger diameter than the one represented in the drawing. If impeller 14 has the maximum possible diameter, the blades 16 and/or the baffles 17 will have their diameter coinciding with the inner diameter 23 of funnel 13. The baffles 17 can be arranged directly along the periphery of impeller 14 without any need for the blades 16.

It has been seen that the diffuser according to the invention eliminates the air pockets at the first filling-up and also the water pockets when the pump is drained.

Figure 6:
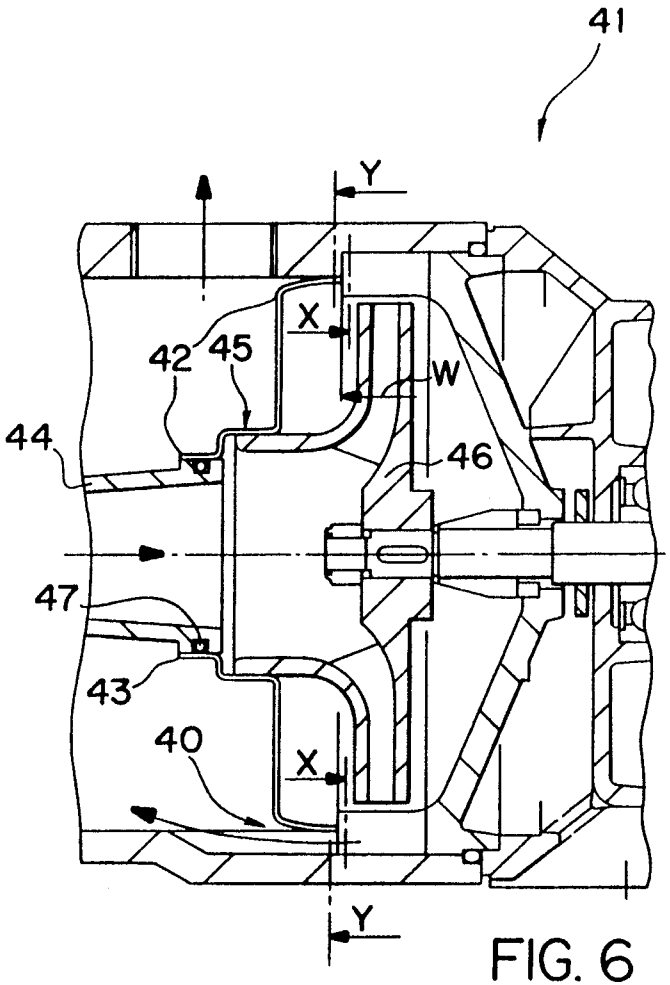
FIG. 6 shows a longitudinal cross-section of the diffuser according to the invention in a different embodiment suited to be applied on a "jet" pump.

A different application of the diffuser according to the invention is shown in FIG. 6, wherein it can be observed that the diffuser 40 according to the invention is applied on a single-impeller, self-priming centrifugal pump 41 of the "jet" type. In this different application the constructive concept of the invention remains the same as the one previously described, with the single difference that funnel 42 is built in a different shape, which, in this case, does not present a suction duct through the pressure chamber. In fact, in this application the funnel provides the sealing wear ring 45 on the impeller 46, as has been seen before, and immediately after that, the terminal end 43 is applied on the ejector 44 of pump 41 through the interposition of washer 47. In this different application on "jet" pumps, diffuser 40 according to the invention also fulfils all the purposes and presents all the advantages that have been previously described, with the further advantage that, in this case, the flow of the propelling liquid going through ejector 44 is not forced into pre-rotation toward impeller 46.

Figure 7:
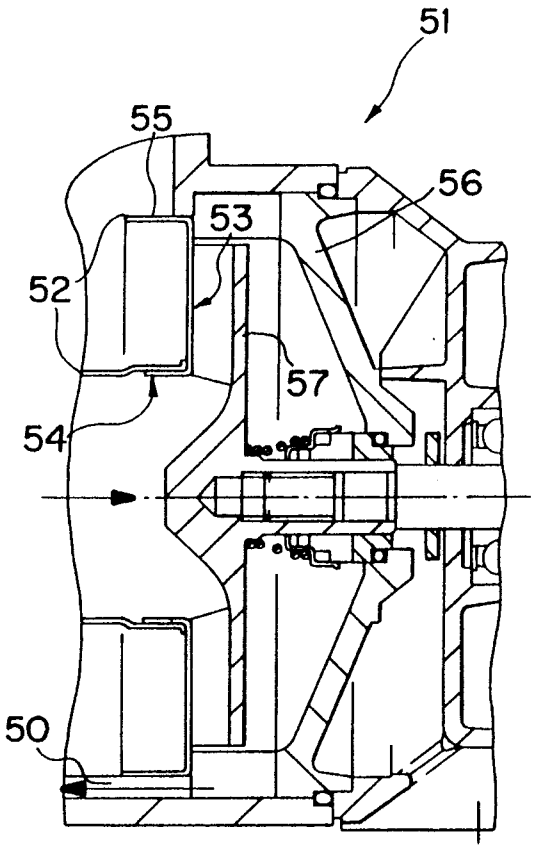
FIG. 7 shows a longitudinal cross-section of the diffuser according to the invention in a different embodiment suited to be applied on a pump with an open impeller.

FIG. 7 shows a different application of the diffuser 50 according to the invention on a single-impeller centrifugal pump 51 with an open impeller 57. In this variation of application, too, the construction concept of the diffuser according to the invention remains the same as previously described, with the single difference that the funnel 52 has a different shape, in that it presents wall 53, connecting ring 54 and the outer belt 55 facing casing cover 56 and the open impeller 57.

Several changes and variations are foreseen, which, based on the same inventive idea, permit different embodiments of the diffuser according to the invention.

A different embodiment is shown in FIG. 8, where it is applied on a single-impeller centrifugal pump 61, where it can be observed that diffuser 60 consists, as has been previously seen, of blades 62 and baffles 63, which are visible in FIGS. 9 and 12, located around the periphery of casing cover 64, which are circumferentially closed around the outer periphery through the annular wall 65 of the pump casing 66. Each of the blades 62 and each of the baffles 63 joint with the front passage 68 of the longitudinal channel 72, which open into the pressure chamber 67. The front passages 68 and the longitudinal channels 72, as can be obeserved in the FIGS. 8, 10, 11 and 12, are no longer located around the periphery of the pump casing 66, but are rather located around the periphery of funnel 69 with the tapered belt 71 and they are closed toward the exterior by the cylindrical belt 65 of the pump casing 66. It will be noticed that the connection between funnel 69 and casing cover 64 is obtained through at least one locating dowel 70, while the front passages 68 can be made in any possible shape.

Figure 16:
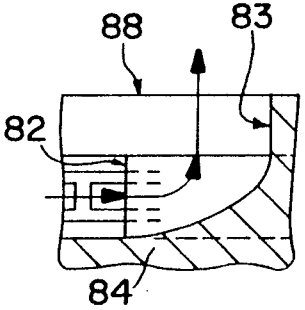
FIG. 16 shows the cross-section on the H plane of FIG. 14, with a view of the extension, over the outer belt of the funnel, of one of the baffles of the casing cover according to the embodiment represented in FIG. 13.
Figure 14:
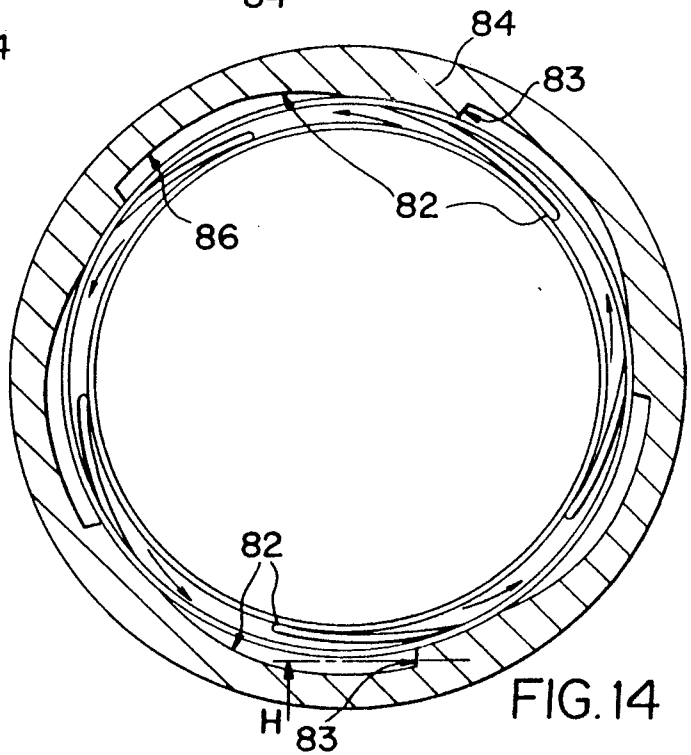
FIG. 14 shows the transversal cross-section on the F—F plane of the embodiment of the diffuser according to the invention represented in FIG. 13, with a front view of the blades and of the baffles of the diffuser according to the invention.
Figure 13:
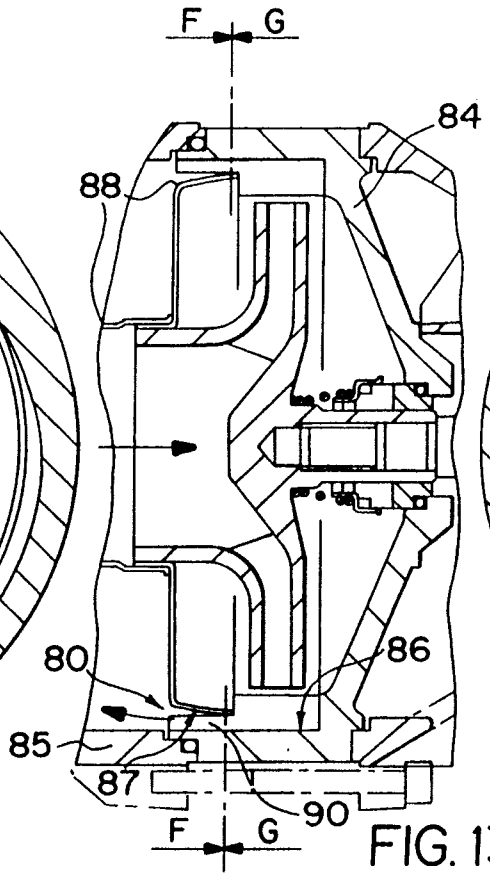
FIG. 13 shows a different embodiment of the diffuser according to the invention with a a different embodiment of the casing cover and of the pump casing.
Figure 15:
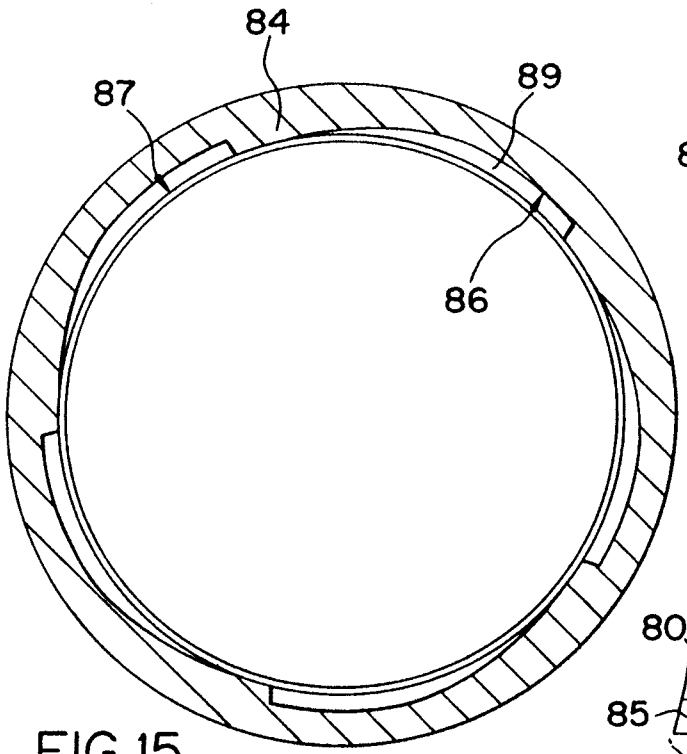
FIG. 15 shows a transversal cross-section on the G—G plane of the embodiment of the diffuser according to the invention represented in FIG. 13, with a front view of the front passages of the longitudinal channels between the casing cover and the funnel of the diffuser according to the invention.

Another embodiment is represented in FIG. 13, applied on a single-impeller centrifugal pump 81, wherein it can be observed that diffuser 80 also consists, as previously described, of blades 82 and baffles 83, visible in the FIGS. 14 and 16, located on casing cover 84. The blades 82 and the baffles 83 are not circumferentially closed by the pump casing 85, but are rather incorporated into the annular wall 86 of casing cover 84. The annular wall 86, the baffles 83 and the terminal end of the blades 82 extend longitudinally over the outer belt 87 of funnel 88, thus forming between funnel 88 and casing cover 84 the front passages 89 and the longitudinal channels 90. The divergence of diffuser 80 can be obtained either by giving a tapered shape to the outer belt 87 of funnel 88 and a cylindrical shape to the annular wall 86 of casing cover 84 or by giving a tapered shape also or only to the annular wall 86 of casing cover 84. In this differring embodiment there is no need for locating dowels for the angular connection between funnel 88 and casing cover 84 or between funnel 88 and the pump casing 85 or between casing cover 84 and the pump casing 85, and this makes the assembly and the taking apart even easier.

Figure 17:
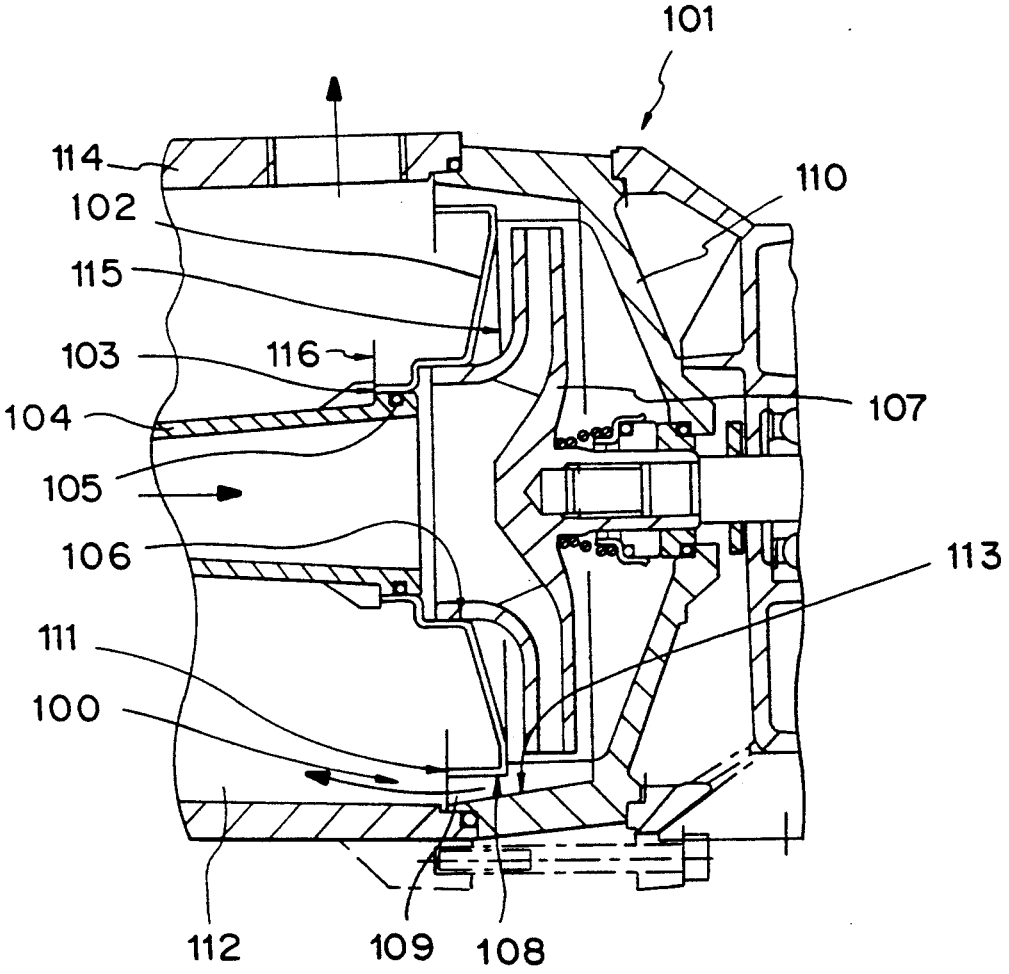
FIG. 17 shows yet another embodiment of the diffuser according to the invention in a shape which is suited to be applied on a "jet" pump.

Yet another embodiment is represented in FIG. 17, wherein it can be observed that the diffuser 100 according to the invention is applied on a single-impeller, self-priming centrifugal pump 101 of the "jet" type. In this embodiment, the constructive idea of the invention remains the same as described for the embodiment of FIG. 13, the only difference consisting in the different constructive shape of the funnel, which, in FIG. 17, consists of a wall 102, shaped so as to comprise the terminal end 103 applied on the ejector 104 through the interposition of washer 105, the sealing wear ring 106 on impeller 107 and the outer belt 108, radially closing toward the interior the longitudinal channels 109 on casing cover 110.

Contrary to the embodiment represented in FIG. 13, the terminal end 111 of the outer belt 108 is not turned toward the casing cover, but it is rather turned toward the pressure chamber 112, as is the case of the embodiment of the funnel in the type of application represented in FIG. 7.

In the embodiment of FIG. 17 the outer belt 108 of wall 102 is preferably made in a cylindrical shape and the divergence of the diffuser 100 is obtained with the tapered shape of the annular wall 113 of casing cover 110.

In this embodiment, too, no locating dowels are necessary for the angular connection between wall 102 and casing cover 110, nor between wall 102 and the pump casing 114 nor between casing cover 110 and the pump casing 114. The longitudinal positioning occurs by placing wall 102 between the front of the blades 115 on casing cover 110 and the catches 116 on ejector 104.

Figure 18:
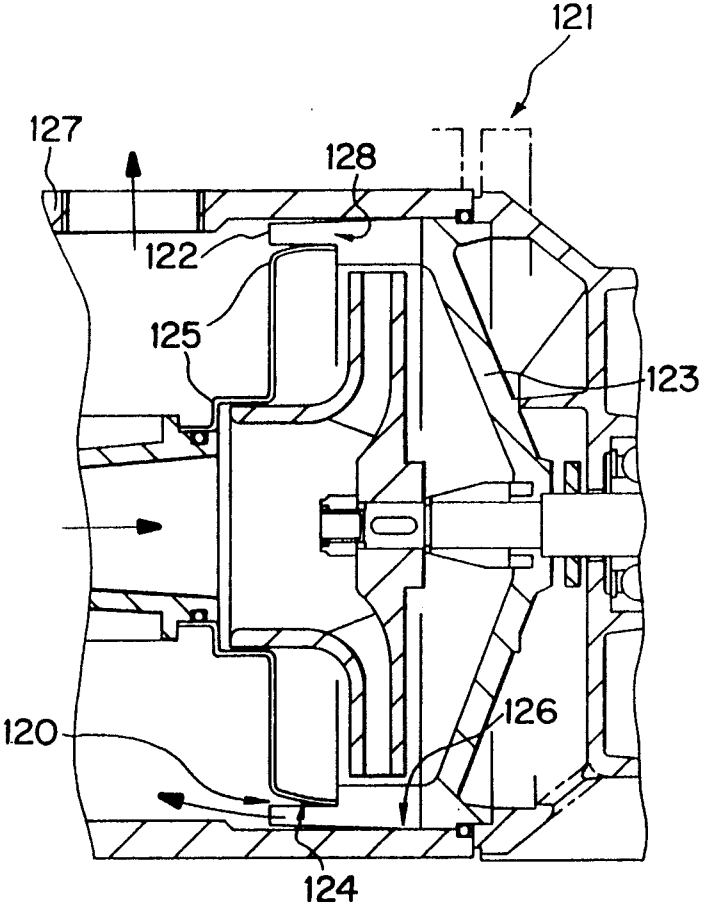
FIG. 18 shows another embodiment of the diffuser according to the invention suited to be applied on a "jet" pump.

Yet another construction embodiment is represented in FIG. 18, wherein it can be observed that diffuser 120 according to the invention is applied on a single-impeller, self-priming centrifugal pump 121 of the "jet" type. In this embodiment, the constructive idea of the invention remains the same as described for the embodiments of the FIGS. 13, 14, 15, 16 and 17, with the difference that the baffles 122, already described and illustrated for the previous embodiments, which are located on casing cover 123, extend longitudinally over the preferably tapered outer belt 124 of the funnel or wall 125 and also in the interior of the inner belt 126 of the pump casing 127.

In this embodiment the longitudinal channels 128 of the diffuser 120 are shaped by the junction between the pump casing 127, casing cover 123 and by the funnel or wall 125.

In this embodiment, too, no locating dowels are required for the angular connection between the pump casing 127, casing cover 123 and the funnel or wall 125.

Figure 19:
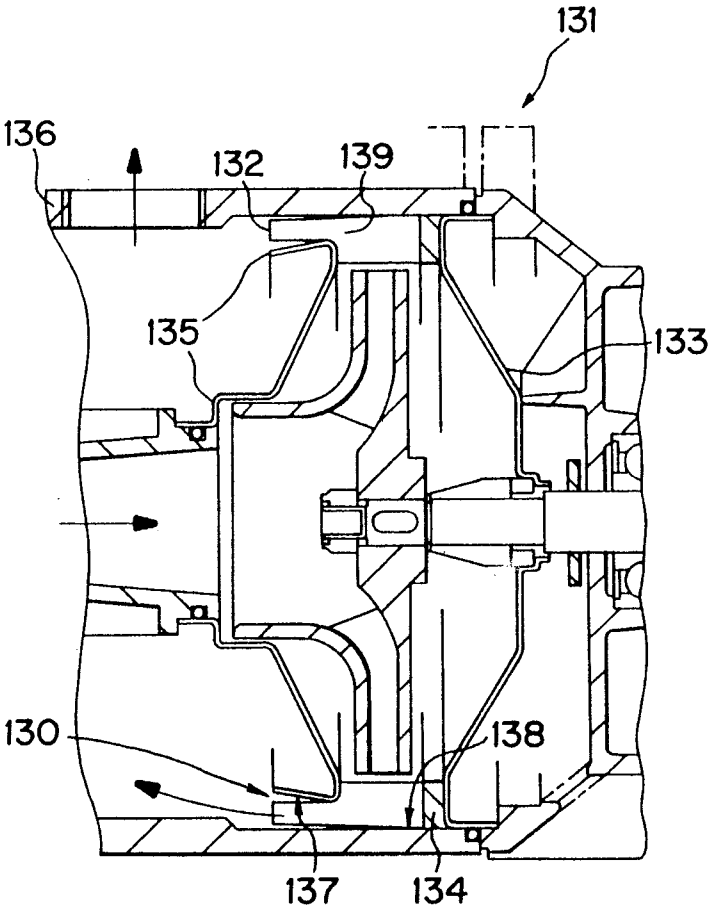
FIG. 19 shows yet another embodiment of the diffuser according to the invention, suited to be applied on a "jet" pump.

Another embodiment is represented in FIG. 19. In this embodiment the concept for the construction of the diffuser 130 according to the invention, which is applied on a "jet"-type pump 131, remains the same as described for the embodiment of FIG. 18, with the difference that the baffles 132 are no longer located on the casing cover 133, but rather are located on a circular rim 134, positioned between casing cover 133, the funnel or wall 135 and the pump casing 136.

In this embodiment the funnel or wall 135 preferably presents a shape which is similar to the one described in the embodiment of FIG. 17, but with the outer belt 137 preferably tapered. In this variation, the circular rim 134 with the baffles 132 is kept its longitudinal position between the funnel or wall 135 and casing cover 133. The circular rim 134 can be prevented from rotating while the impeller is running, by coupling it in seat 138 in the pump casing 136 or by the pressure caused by the blocking between the funnel or wall 135 and casing cover 133. In this embodiment, too, no location dowels are necessary for the angular connection between the various parts forming the longitudinal channels 139 of diffuser 130.

The various embodiments which have been described also fulfil all the purposes which have been proposed by this invention and also permit the achievement of all of its advantages. During the manufacturing process of the diffuser according to the invention, changes and modifications of a constructive or functional nature may be applied in order to improve its efficiency or its manufacture. Thus, for instance, it will be possible to vary the shape and the number of the blades, of the baffles and of the longitudinal channels, as can be varied their radial and axial dimensions. It is, however, understood that said possible changes, as well as all the combinations arising from the described and illustrated embodiments will not exceed the scope and spirit of the present invention.

I claim:

1. A diffuser for single-impeller centrifugal pumps, comprising:

a pump casing provided with a suction opening, with a delivery connection and a pressure chamber;

a casing cover closing the pump casing;

a impeller located in said pump casing and having an axis of rotation;

a funnel, positioned within the pump casing between the pressure chamber and the suction of the impeller and also between the suction opening and the casing cover;

said impeller being located between the funnel and the casing cover, channel means for directing flow coming from the impeller solely in a substantially straight longitudinal direction into said pressure chamber, with said substantially straight longitudinal direction being substantially parallel to said axis of rotation of the impeller in order to prevent rotation of the flow coming from the impeller;

said channel means consisting of a plurality of channels connected with the pressure chamber of the pump, said channels have a longitudinal direction which is substantially parallel to the axis of rotation of the impeller, said channels are arranged in front of the impeller on the suction side of the impeller and directed toward the pressure chamber, around an outside funnel periphery, and baffle arranged around a periphery of the impeller are connected with the longitudinal channels.

2. A diffuser according to claim 1, wherein the baffles are complete with stationary blades arranged around the periphery of the impeller.

3. A diffuser according to claim 1, wherein the longitudinal channels are located in the pump casing and are radially closed toward an interior of an outer belt of the funnel.

4. A diffuser according to claim 1, wherein the longitudinal channels are located on the funnel and are radially closed toward an exterior by a cylindrical belt of the pump casing.

5. A diffuser according to claim 1, wherein the longitudinal channels are located in the casing cover and are radially closed toward an interior by an outer belt of the funnel.

6. A diffuser according to claim 1, wherein each of said longitudinal channels is formed by a junction between the pump casing, the casing cover and the funnel, each of said longitudinal channels is closed toward an exterior by an inner belt of the pump casing toward an interior by an outer belt of the funnel and laterally by the baffles located on the casing cover and positioned between the inner belt of the pump casing and the outer belt of the funnel.

7. A diffuser according to claim 1, wherein each of said longitudinal channels is formed by a junction between the pump casing, the funnel and the baffles, the baffles being located on a circular rim not forming separate from the casing cover.

8. A diffuser according to claim 2, wherein the baffles and the stationary blades are located on the casing cover and are peripherally delimited by an annular wall of the pump casing.

9. A diffuser according to claim 2, wherein the baffles and the stationary blades are located on the casing cover and are peripherally delimited by an annular wall of the casing cover.

10. A diffuser according to claim 1, wherein the baffles are located on the funnel.

* * * * *

UNITED STATES PATENT AND TRADEMARK OFFICE

CERTIFICATE OF CORRECTION

PATENT NO. : 5,226,790
DATED : July 13, 1993
INVENTOR(S) : Carki Serafin

It is certified that error appears in the above-indentified patent and that said Letters Patent is hereby corrected as shown below:

Title page, item [54] and col. 1, in the Title change "DIFFUSSER" to -- DIFFUSER --.

In Column 1, line 26, after "casing" insert -- . -- (a period)

In Column 1, lines 27, change "such" to -- Such --

In Column 3, line 22, delete "and of the water"

In Column 3, line 30, delete "diffuser having a"

In Column 3, line 31, change "with" to "having"

In Column 8, line 17, after "functions" insert -- as --

In Column 12, claim 7, line 28, delete "not forming"

Signed and Sealed this

Twenty-fourth Day of October, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,226,790

DATED : July 13, 1993

INVENTOR(S) : Carlo Serafin

It is certified that error appears in the above-indentified patent and that said Letters Patent is hereby corrected as shown below:

In Fig. 1, delete numeral "11" (second occurrence) as set forth in the lower central portion of the figure.

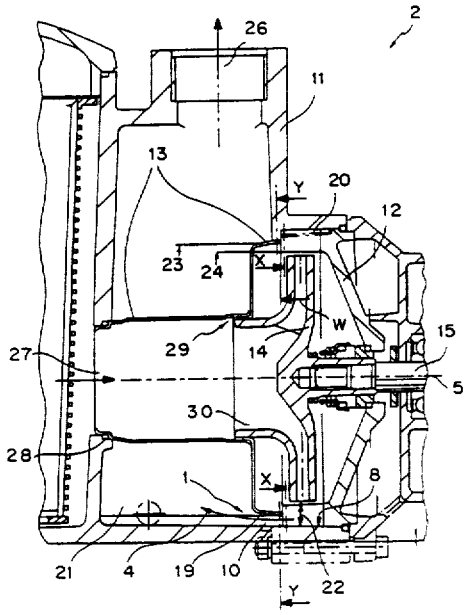

FIG.1

UNITED STATES PATENT AND TRADEMARK OFFICE

CERTIFICATE OF CORRECTION

PATENT NO. : 5,226,790

DATED : July 13, 1993

INVENTOR(S) : Carlo Serafin

It is certified that error appears in the above-indentified patent and that said Letters Patent is hereby corrected as shown below:

In Fig. 2, insert numeral 20.

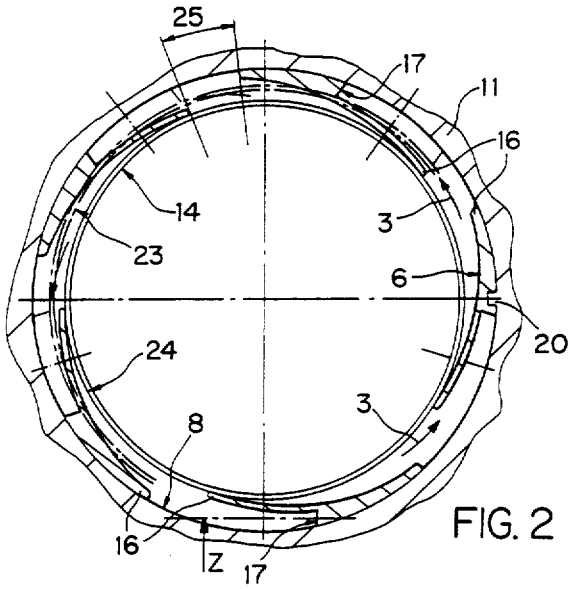

FIG. 2

UNITED STATES PATENT AND TRADEMARK OFFICE

CERTIFICATE OF CORRECTION

PATENT NO. : 5,226,790

DATED : July 13, 1993

INVENTOR(S) : Carlo Serafin

It is certified that error appears in the above-indentified patent and that said Letters Patent is hereby corrected as shown below:

In Fig. 11, the lead line of numeral 68 has been extended to indicate a frontal passage.

FIG.11

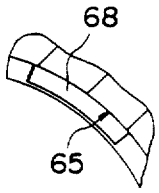

UNITED STATES PATENT AND TRADEMARK OFFICE

CERTIFICATE OF CORRECTION

PATENT NO. : 5,226,790

DATED : July 13, 1993

INVENTOR(S) : Carlo Serafin

It is certified that error appears in the above-indentified patent and that said Letters Patent is hereby corrected as shown below:

In Fig. 13, the arrow and numberal "81" have been inserted to indicate the centrifugal pump.

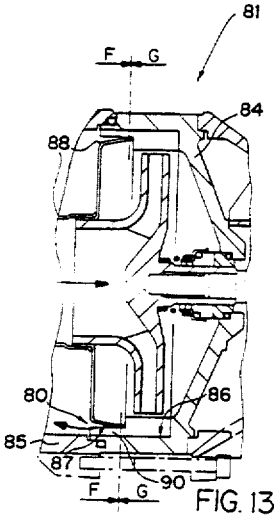

FIG. 13